United States Patent [19]

Ring

[11] Patent Number: 4,927,042

[45] Date of Patent: May 22, 1990

[54] DISPENSING BOTTLE CONTAINER ASSEMBLY INCLUDING SEPARABLE COMPOSITE PACKAGES

[75] Inventor: Robert G. Ring, Memphis, Tenn.

[73] Assignee: Ring Can Corporation, Oakland, Tenn.

[21] Appl. No.: 330,487

[22] Filed: Mar. 30, 1989

[51] Int. Cl.[5] ..... B65D 21/02; B67D 5/00

[52] U.S. Cl. ..... 220/23.83; 206/431; 220/410; 222/183; 222/465.1; 229/117.13

[58] Field of Search ..... 206/427, 431, 602; 220/23.83, 23.86, 400, 403, 408, 410, 411, 461, 462, 465; 222/105, 107, 183, 465.1, 466; 229/52 B, 117.13

[56] References Cited

U.S. PATENT DOCUMENTS

| | | | |
|---|---|---|---|
| 2,019,307 | 10/1935 | Hill et al. | 229/52 B |
| 2,885,839 | 5/1959 | Weiss | 206/459 X |
| 2,954,901 | 10/1960 | Winstead | 220/410 X |
| 2,981,459 | 4/1961 | Johnson et al. | 229/52 B |
| 3,114,496 | 12/1963 | Wilcox | 206/431 X |
| 3,119,544 | 1/1964 | Cope et al. | 229/52 B |
| 3,160,326 | 12/1964 | Sturdevant et al. | 222/466 X |
| 3,221,876 | 12/1965 | Currie | 206/431 |
| 3,233,817 | 2/1966 | Casady | 222/105 X |
| 3,254,824 | 6/1966 | Lang | 229/52 B X |
| 4,133,428 | 1/1979 | Glöyer | 206/427 |
| 4,314,639 | 2/1982 | Glöyer | 206/427 |
| 4,524,883 | 6/1985 | Herring | 220/462 |

FOREIGN PATENT DOCUMENTS

| | | | |
|---|---|---|---|
| 666985 | 7/1963 | Canada | 220/410 |

*Primary Examiner*—Bryon P. Gehman

*Attorney, Agent, or Firm*—Nies, Kurz, Bergert & Tamburro

[57] ABSTRACT

A container assembly comprising two composite packages fastened together for packaging and shipping, but separable for individual use at a retail location. Each package includes an outer paperboard carton and a plastic bottle contained therein, the liquid in the bottle being pourable without removing the bottle from the carton The carton is rectangular and includes front, rear and side walls and a closure flap assembly at its upper end including first and second side flaps connected to and folded substantially perpendicular to said side walls. The edges of the side flaps are shaped to form a first opening for the spout and a second opening defining a handle. The flap assembly also has front and rear flaps which fold over the side flaps and have edges which lie adjacent each other. The front flap has a third opening which aligns with the first opening to accommodate the spout, and the rear flap has a perforated section which aligns with the second opening to form the handle. A second flap assembly at the bottom of the carton includes a handle forming structure.

2 Claims, 2 Drawing Sheets

DISPENSING BOTTLE CONTAINER ASSEMBLY INCLUDING SEPARABLE COMPOSITE PACKAGES

BACKGROUND OF THE INVENTION

This invention relates generally to containers for pourable liquids or powders, and more particularly to a novel container assembly in which two composite packages are connected together for shipment and then separated for use individually.

In the packaging industry, it is common to package and ship liquids to fast food chains in 5-gallon quantities. This is often done through the use of a single 5-gallon plastic container which is heavy and difficult to pour, or, alternatively, two 2½-gallon molded plastic containers packed in a single carton. In the latter case, each lighter 2½-gallon container includes an integrally molded handle which facilitates removal of this container from the carton and pouring of its contents at the retail station. While this is an improvement over the single 5-gallon container, it nevertheless is not ideal since each bottle must be labelled along with the carton in which the bottles are packaged, and each bottle must be provided with its own molded handle. The need for the handle on each bottle complicates the molding process and, together with the labelling requirement, increases cost.

SUMMARY OF THE INVENTION

Accordingly, the primary object of the invention resides in the provision of a novel container assembly comprising two composite packages separably connected together for packaging and shipping purposes, each package including an outer paperboard carton and a lightweight molded plastic bottle within the carton.

Another object of the invention resides in the provision of the above novel container assembly, wherein the packages are separated for use and the contents in each bottle are poured without having to remove the bottle from its carton.

Still another object of the invention resides in the provision of the above novel container assembly, wherein the spout of the bottle is exposed through the carton and the carton has handle means to facilitate pouring of the contents from the bottle.

A further object of the invention resides in the provision of the above novel container assembly, wherein the composite packages are identical and are taped together in side-by-side arrangement for packaging and shipping purposes.

Another object of the invention resides in the provision of the above novel container assembly, wherein one end wall of the carton includes a unique flap construction which has an opening through which the spout extends and handle means by which the package is manipulated.

A still further object of the invention resides in the provision of the above novel container assembly, which satisfies the desire of the packaging industry to package and ship a predetermined larger volume of material, e.g. 5 gallons, and yet facilitates handling of a smaller volume, e.g. 2½ gallons, at the retail level. In addition, the contents of the inner bottle are pourable without having to remove the bottle from its carton.

Other objects and advantages will become apparent as the description proceeds in connection with the accompanying drawings.

DETAILED DESCRIPTION OF THE INVENTION

Figure 2:
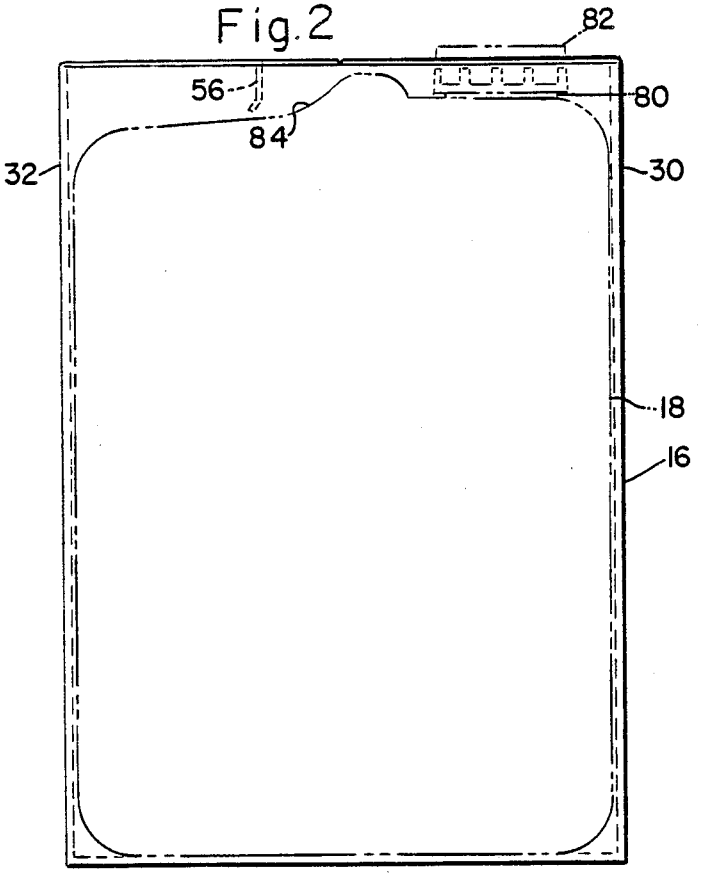
FIG. 2 is a side elevational view of one of the composite packages taken along line 2—2 of FIG. 1.
Figure 1:
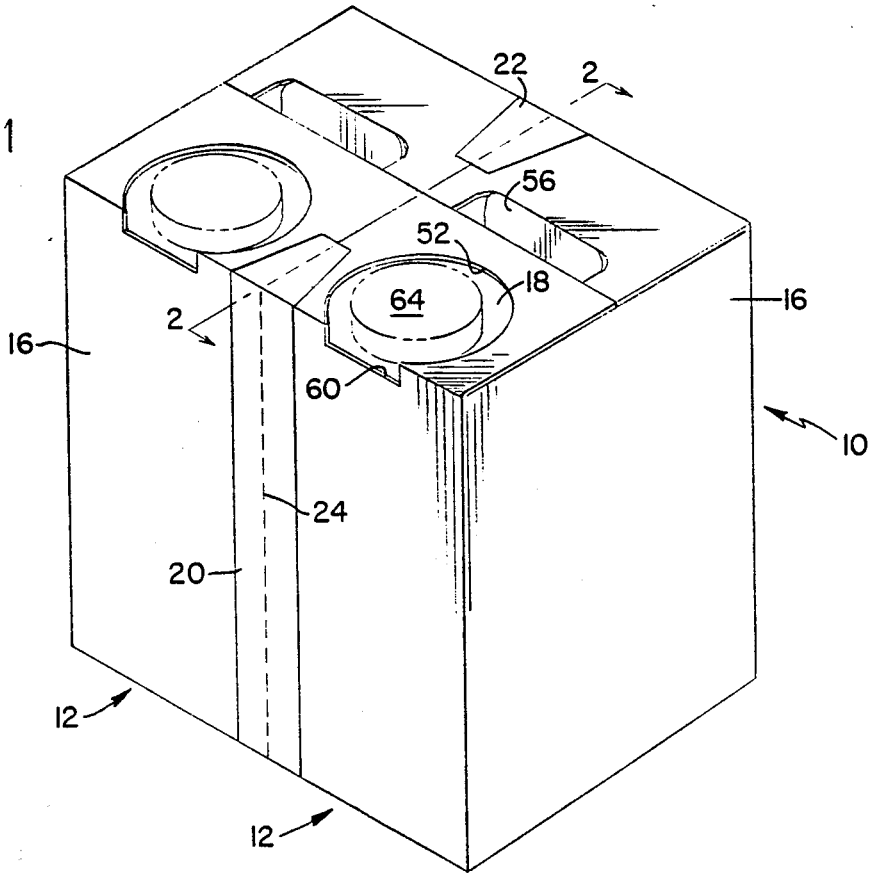
FIG. 1 is a general perspective view of the container assembly in the normal upright position.

Referring now to FIGS. 1 and 2, the novel rectangular container assembly 10 of the invention comprises two identical composite packages 12 each including an outer rectangular corrugated paperboard carton 16 and a lightweight molded plastic bottle 18 which fits snugly therein. The bottles 18 are of a predetermined capacity, e.g. 2½ gallons, convenient for lifting and handling individually. To comply with the industry practice of packaging and shipping in 5 gallons quantities, assembly 10 is formed by two side by side packages 12 whose cartons 16 abut along one side wall. Adhesive strips 20 and 22 overlap adjacent edges of the front and back walls and a portion of the top and bottom walls of cartons 16 to separably fasten the cartons together, with strips 20 and 22 having a tear or cut line 24 along which separation is effected.

Figure 3:
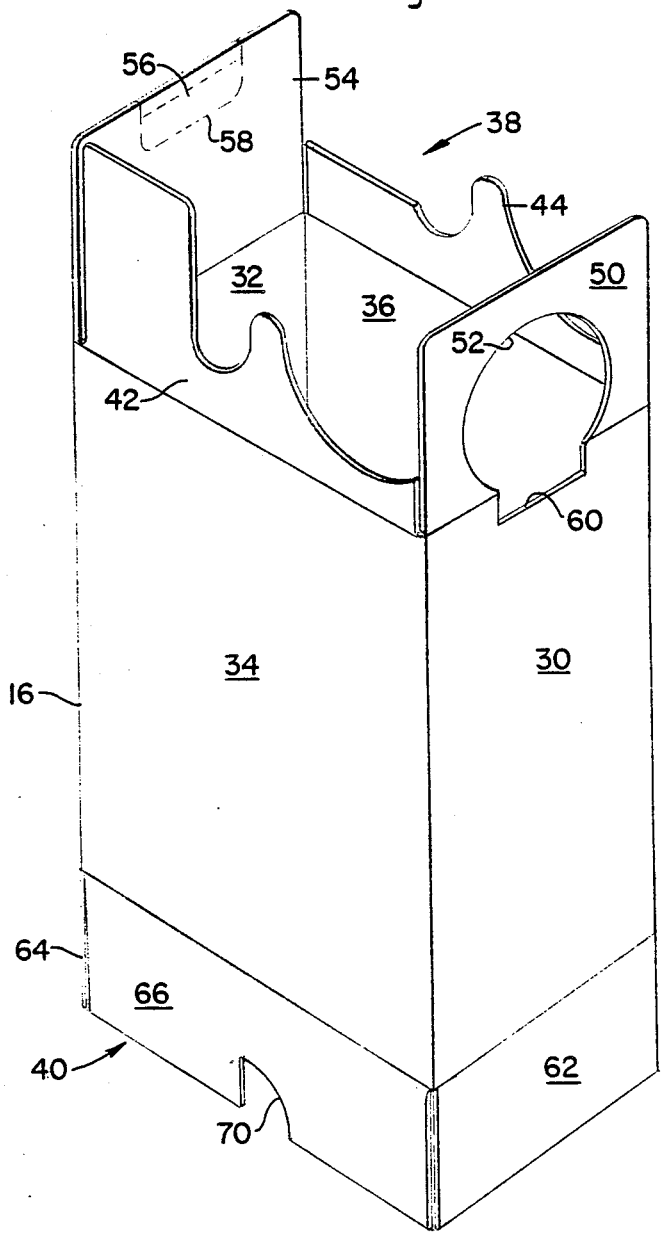
FIG. 3 is an elevational perspective view of the outer carton of the package, illustrating the top and bottom end flap assemblies in their open, unfolded positions.
Figure 4:
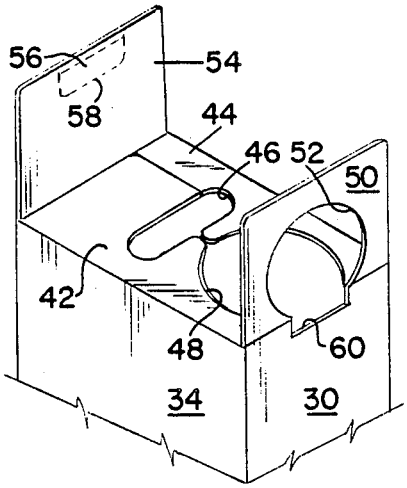
FIG. 4 is a fragmentary perspective view of the top end flap arrangement, showing the side flaps in their folded position.
Figure 5:
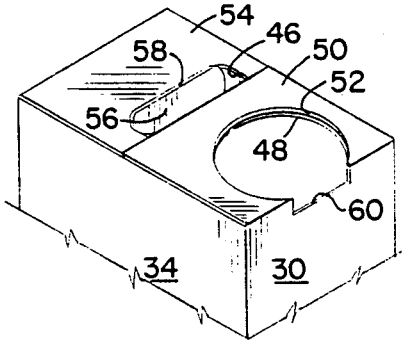
FIG. 5 is a view similar to FIG. 4, showing the front and rear flaps in their folded positions.

As shown in FIG. 3 the outer vertical rectangular carton 16 includes front wall 30, rear wall 32, side walls 34 and 36, a foldable top end flap assembly 38, and a foldable bottom end flap assembly 40. Top flap assembly 38 includes side flaps 42 and 44, the edges of which have die-cut sections which come together to form a hand slot 46 and a circular opening 48 when the flaps are folded horizontally as shown in FIG. 4. Front flap 50 has a die-cut opening 52 which aligns with opening 48 when flap 50 is folded as in FIG. 5. Rear flap 54 has a handle section 56 perforated along line 58 so that section 56 may be folded downwardly into slot 46 when flap 54 is folded over as in FIG. 5.

Front wall 30 has a rectangular cut out section 60 extending downwardly from opening 52. Flaps 50 and 54 are adhesively secured on flaps 42 and 44.

Figure 6:
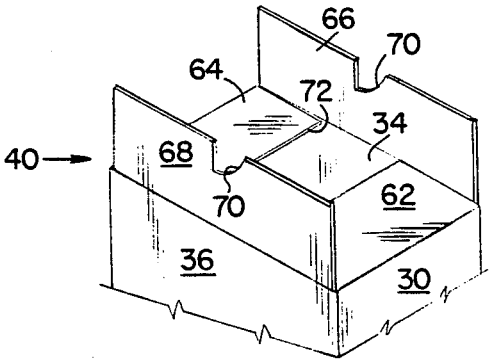
FIG. 6 is a fragmentary perspective view of the bottom end flap arrangement, showing the front and rear flaps in their folded position.

Bottom flap assembly 40 includes front flap 62, rear flap 64 and side flaps 66 and 68, each having a die cut section 70. As shown in FIG. 6 when flaps 62 and 64 are folded horizontally, their edges are spaced from each other to define an opening 72. When flaps 66 and 68 are folded flat as in FIG. 7, sections 70 cooperate to define a hand opening 76 overlying opening 72. Flaps 66 and 68 are adhesively secured over flaps 62 and 64.

Figure 7:
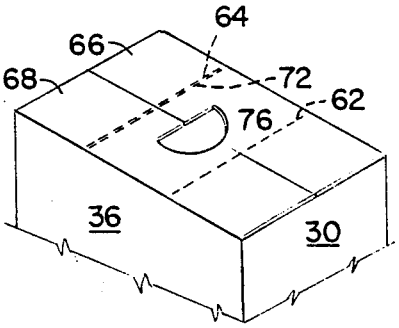
FIG. 7 is a view similar to FIG. 6, showing the bottom side flaps in their folded position.

During packaging, carton 16 is first opened to the condition of FIG. 3. Bottom flap assembly 40 is folded successively as shown in FIGS. 6 and 7 with flaps 62 and 68 glued on flaps 62 and 64. After bottle 18, filled with a particular liquid, is placed inside carton 16 as in FIG. 2, top flap assembly 38 is folded successively as in FIGS. 4 and 5 with flaps 50 and 54 glued onto flaps 42 and 44. The pouring spout 80 and cap 82 of bottle 18 is positioned within openings 48 and 52 and hand flap 56 is within slot 46. The area 84 of bottle 18 beneath slot 46 is depressed (FIG. 2) to provide clearance for a person's fingers as they grip handle 56.

As thus packaged, the liquid in bottle 18 can be poured without removing it from carton 16. Openings 48 and 52 are large enough in diameter so that they, together with front recess 60, provides comfortable clearance for a person's fingers in unscrewing cap 64. After removing cap 64, a person can grasp top handle 56 with one hand and bottom handle slot 76 with the other hand and pour the liquid. Consequently, bottle 18 need not have a separate handle, thus simplifying and reducing the cost of the bottle manufacturing process. In addition, since bottle 18 is not removed from carton 16, the bottle need not be separately labelled, the label on the carton being sufficient for identification purposes.

To conform to the industry practice of shipping in 5-gallon quantities and to reduce shipping costs, two composite packages 12 are then secured together by applying strips 20 and 22 and forming the rectangular container assembly 10 as shown in FIG. 1. During shipping and storage, container assemblies 10 are conveniently stackable to save space and facilitate handling. At the retail store, strips 20 are separated along line 24 and the individual packages 12 are used as described above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to the embraced therein.

What is claimed and desired to be secured by Letters Patent is:

1. A container assembly comprising at least two packages arranged side by side, each package including an outer rectangular carton and a bottle mounted within said carton, said bottle having a pouring spout at one end thereof, said carton including front, rear, and first and second side walls, a flap assembly at one end of said carton including first and second side flaps connected to said side walls and folded substantially perpendicular to said side walls, said first and second side flaps having their edges shaped so as to cooperate to form a first opening for said spout and a second opening defining a handle, front and rear flaps connected to said front and rear walls and folded over said side flaps, said front and rear flaps having edges which lie adjacent to each other, said front flap having a third opening aligning with said first opening to accommodate said spout, said rear flap having means cooperating with said second opening to form said handle, said front wall having a recess intersecting and extending downwardly from said third opening, said carton having a bottom flap assembly at its other end and including bottom front and rear flaps folded perpendicularly from said front and rear walls and having edges spaced from each other to define a bottom opening, and bottom side flaps connected to said side walls and folded over said bottom front and rear flaps, said bottom side flaps including means defining a handle overlying said bottom opening, and means separably connecting together the outer cartons of said packages, whereby said packages are shipped together as an assembly and then separated for use individually without having to remove the bottle from its carton.

2. The container assembly according to claim 1, said connecting means comprising adhesive strip means for fastening adjacent edges of said outer cartons together.

* * * * *